United States Patent [19]

Barnes

[11] Patent Number: 4,937,963

[45] Date of Patent: Jul. 3, 1990

[54] PROTECTIVE ENCLOSURE FOR DATA CARDS

[75] Inventor: Robert B. Barnes, Los Gatos, Calif.

[73] Assignee: Drexler Technology Corporation, Mountain View, Calif.

[21] Appl. No.: 275,150

[22] Filed: Nov. 21, 1988

[51] Int. Cl.[5] ..... G09F 3/18

[52] U.S. Cl. ..... 40/642; 40/661; 40/1.6

[58] Field of Search ..... 40/1.5, 1.6, 642, 661, 40/299, 5; 2/250, 247, 254, 279; 229/71; 206/37, 232; 283/75, 77; 224/230

[56] References Cited

U.S. PATENT DOCUMENTS

| | | | |
|---|---|---|---|
| 1,895,704 | 1/1933 | Crosby | 40/642 |
| 2,285,670 | 6/1942 | Logsdon | 40/1.5 X |
| 2,361,670 | 10/1944 | Whitehead | 40/642 X |
| 2,544,618 | 3/1951 | Smith | 40/642 |
| 2,630,640 | 3/1953 | Stevenson | 40/642 |
| 2,650,444 | 9/1953 | Coyle et al. | 40/661 X |
| 3,295,235 | 1/1967 | Tauber | D11/95 X |
| 3,371,829 | 3/1968 | Phillips | 206/232 X |
| 3,921,318 | 11/1975 | Calavetta | 283/75 X |
| 3,999,317 | 12/1976 | Owens | 40/1.5 |
| 4,259,797 | 4/1981 | Belser | 40/1.5 |
| 4,509,277 | 4/1985 | Bolton | 40/1.5 |
| 4,711,347 | 12/1987 | Drexler et al. | 40/642 X |

FOREIGN PATENT DOCUMENTS

| | | | |
|---|---|---|---|
| 9742 | of 1885 | United Kingdom | 40/299 |
| 567181 | 2/1941 | United Kingdom | 40/299 |

*Primary Examiner*—James R. Brittain
*Assistant Examiner*—J. Hakomaki
*Attorney, Agent, or Firm*—Thomas Schneck

[57] ABSTRACT

A protective enclosure having two hingedly connected sections. One section being a resealable pocket, in which a data card is stored. The other section being a flap which is hingedly attached along one of its edges to the pocket, thereby allowing the flap to swing out from the pocket. The flap has two surfaces on which eye-readable and machine-readable information may be stored. A photograph may also be found on a surface of the flap. The data card stored in the pocket may contain data related to the information found on the flap. This data may be digitally written on the data card by a laser. An alternative embodiment of the enclosure provides two pockets hingedly connected together.

23 Claims, 3 Drawing Sheets

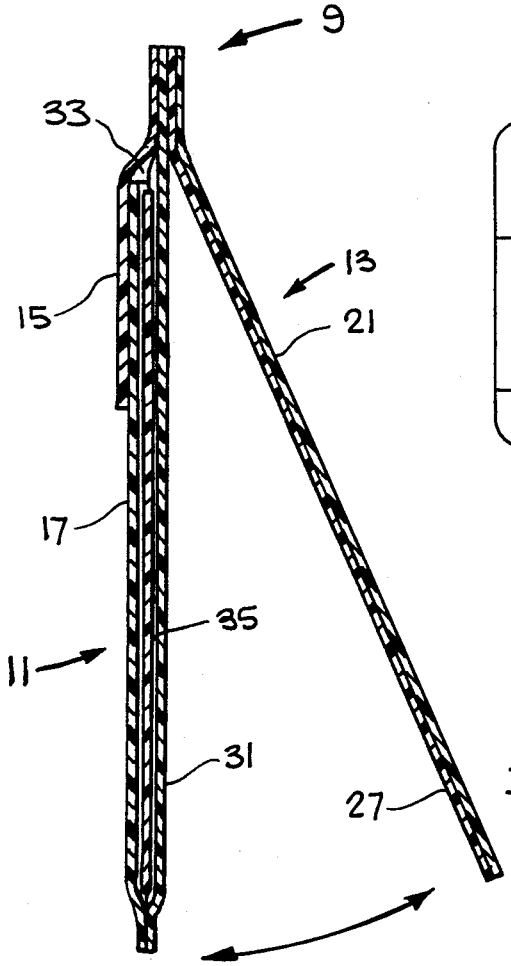
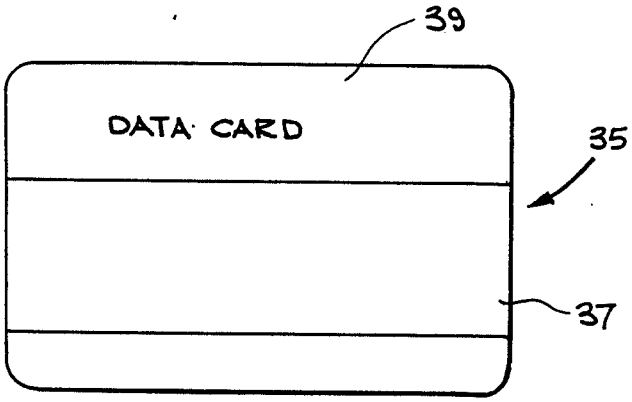
Fig. 4
Fig. 3
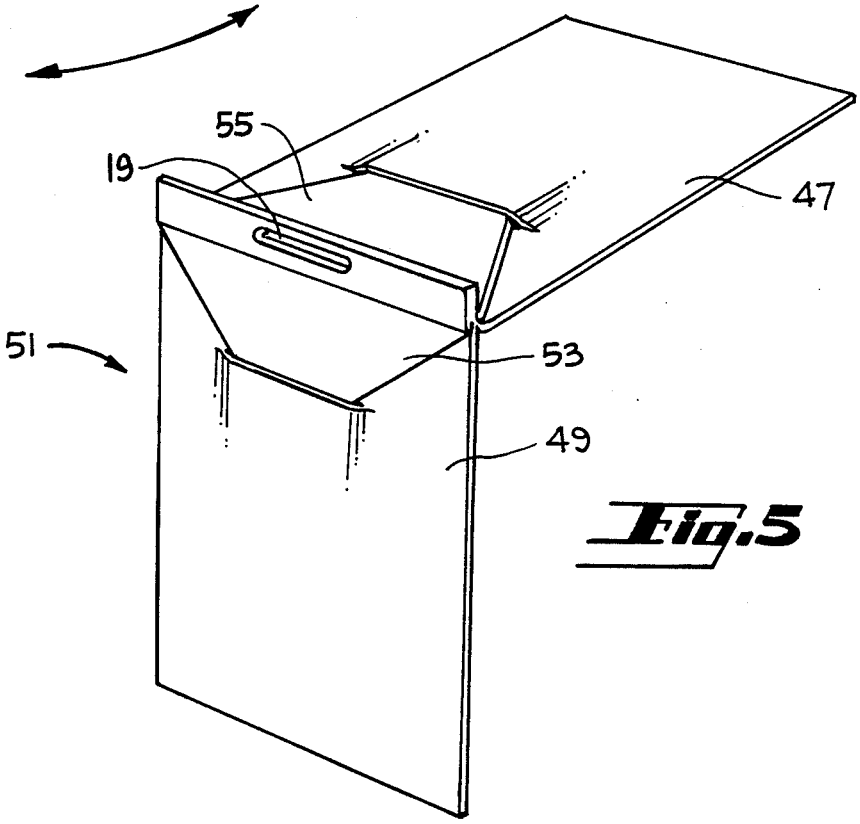
Fig. 5

PROTECTIVE ENCLOSURE FOR DATA CARDS

DESCRIPTION

TECHNICAL FIELD

This invention relates to protective enclosures, and more particularly to personally carriable enclosures for identification and medical history cards.

BACKGROUND ART

Data cards have many forms and uses. Some of these uses include identification, medical record storage, banking transactions, security access, purchasing and others. It is recognized that these cards need to be protected while being carried in one's wallet or purse. Contaminants such as dust and dirt on the surface of a card, as well as scratches and other deformities, can cause errors in reading the card. Optically written and read cards have a particular problem with dust and dirt. Two primary optical card applications for which this is a significant problem are personal medical cards and identification/security access cards.

Optically-written personal medical cards have an optical recording area for optically-recorded information such as medical history charts or digitized test data. Some personal medical cards will also have an area for eye-readable information which is used often during routine medical situations. This information is generally for identification purposes. There might also be limited machine-readable data stored on magnetic strips or bar code symbols. Since the optical recording area will be exposed to environmental hazards every time the medical card is handled, there is significant risk of the optical area becoming dirty.

The same problem of contamination exists with data cards used in identification/security access applications, as was described for medical cards. Optically-recorded identification cards generally have an optical recording area and an eye-readable information area, often including a photograph. In many cases, the eye-readable information is intended to be visible for long periods of time, as with identification badges in work-places. Often these badges will have low-level security access codes stored on magnetics strips, for use in access control devices. The optically-recorded information is generally intended to be used in high level access applications or as a personal data history. Frequent exposure of the card or badge to the environment increases the likelihood of contamination of the recording surfaces.

It is an object of the present invention to devise a protective holder for optically-written data cards, that limits the exposure to the environment of the optical recording area, but still allows for convenient use of any eye-readable or limited machine-readable information associated with the optically-written cards.

DISCLOSURE OF THE INVENTION

The above object has been met by an enclosure for data cards having two hingedly connected sections for protecting optically recorded cards. One section is a pouch or pocket that has a resealable closure. A digital data card is stored in the pocket, when not in use. The other section is a flap which is connected along an edge to the pocket so as to allow the flap to rotate about that edge. Eye-readable and machine-readable information, along with any photographs associated with the data card are stored on the flap. The flap is made up of an inside surface layer and a transparent outside covering.

The inside layer faces the pocket section, while the outside layer faces away from the pocket, when the flap and pocket are folded together. The eye-readable information and photographs are stored on the outside covering of the flap, thereby allowing ready viewing of this information. On the inside surface of the flap, machine-readable information may be stored on magnetic strips. Access to the inside surface of the flap is provided by flipping the flap out away from the pocket. Therefore, convenient access is maintained for the information which is most often used, while the data card is kept from unnecessary exposure to the environment.

BRIEF DESCRIPTION OF THE DRAWINGS

FIG. 1(*a*) is a perspective view of the embodiment of the present invention shown in FIG. 1.

FIG. 2(*a*) is a front view of a flap section of the present invention.

FIG. 3 is a cross-sectional view of the enclosure taken along 3—3 in FIG. 1(*a*).

FIG. 4 is a front view of a data card.

FIG. 5 is a perspective view of a second embodiment of the present invention.

BEST MODE FOR CARRYING OUT THE INVENTION

Figure 1:
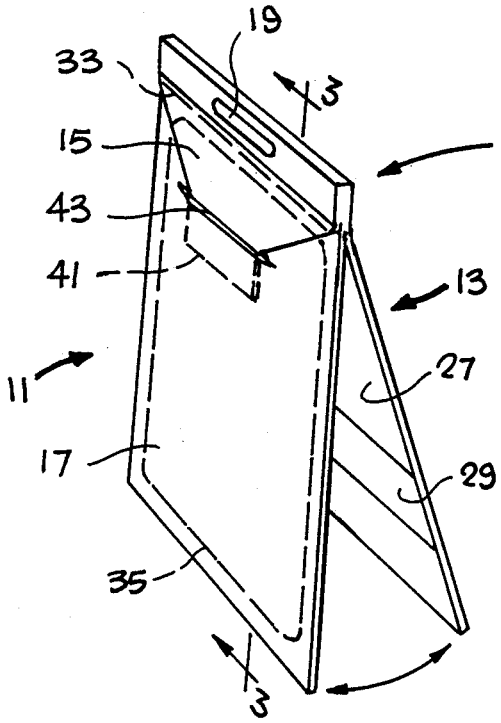
FIG. 1 is a perspective view of an embodiment of the present invention.
Figure 1:
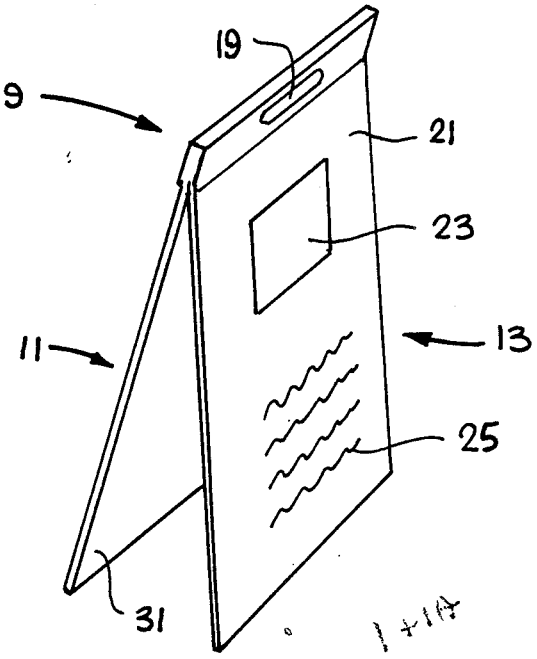

With reference to FIG. 1, an embodiment of the present invention is shown wherein a protective enclosure 9 has two sections for storing data, a pocket 11 and a flap 13. The outward facing layer 21 of flap 13 is depicted as having a photograph 23 and eye-readable data 25. Flap 13 is hingedly connected to pocket 11 such that the flap may swing freely away from the pocket and expose the base layer 31 of the pocket. Slot 19 is provided for attachment of a clip, not shown, to the enclosure such as is common with identification badges.

FIG. 1(*a*) shows the pocket 11 of the enclosure containing a data card 35 as indicated by the dashed lines. Pocket 11 has a resealable opening 33 through which the data card may be inserted or removed from the pocket. Opening 33 may be repeatedly sealed by fold 15 which is removably secured to the front layer 17 of the pocket by inserting a tab 41 located at an end of the fold into a slit 43 in the front layer. Other means may also be used in the present invention for securing fold 15 to the front layer such as Velcro strips, snaps, magnets and reusable adhesive tape. Alternatively, opening 33 may be resealable by a means which doesn't involve having a fold, such as pressure sealed ridges common to plastic storage bags. When flap 13 is swung away from pocket 11, inside layer 27 is exposed, and magnetic strip 29 may then be accessed by a machine for reading. Strip 29 is not on the card, but on the flap of the card enclosure.

Figure 2:
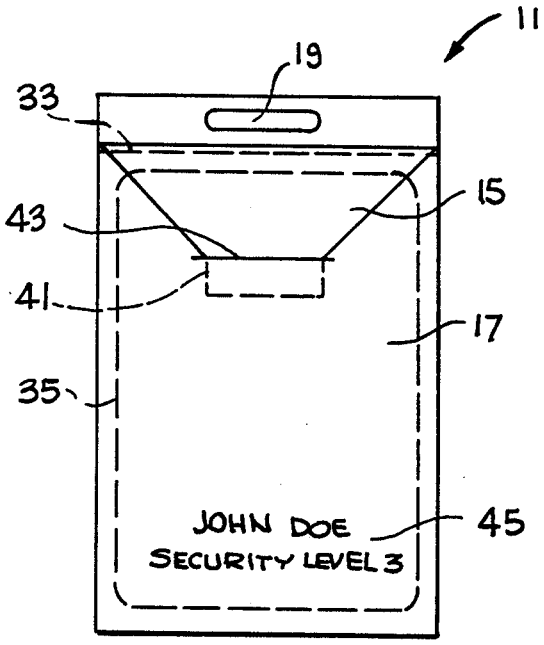
FIG. 2 is a front view of a pocket section for the present invention.
Figure 2:
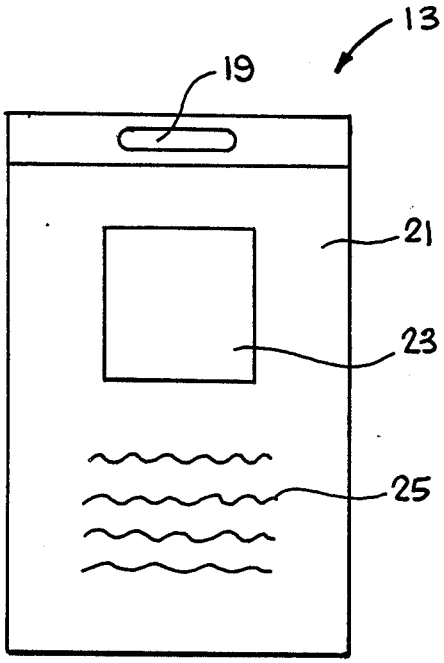

In FIG. 2 front layer 17 of the pocket 11 may be seen. Opening 33 indicated by the dashed line is shown to be near the end of the pocket which is closest to slot 19. However, the opening may be placed near the opposite end of the pocket or may even be placed on the other side of the pocket. Where the opening is placed is unimportant so long as it can be resealed and a data card can be inserted through the opening into the pocket.

Dashed box 35 represents a data card which is contained in the pocket. Fold 15 is shown folded over opening 33 thereby sealing the opening and keeping the data card from exposure to the environment. The fold is held closed by inserting a tab 41 of the fold into slit 43. Front layer 17 may have an indicia bearing area 45.

FIG. 2(*a*) illustrates the flap section 13 of the present invention. The outside layer 21 of the flap is shown to have a photograph 23 and eye-readable data 25. Generally, the outside layer will appear much like an identification badge or identification card, wherein the photograph is of the user and the visible data is user identification information. Typically, this information will be used for low level and frequently performed uses.

Referring to FIG. 3, enclosure 9 is shown to provide a flap 13 and a pocket 11. Flap 13 is hingedly connected to pocket 11, and is shown to swing freely from the pocket. Data card 35 is stored in pocket 11 so as to keep it from becoming contaminated. Fold 15 covers the opening 33 to the pocket. Fold 15 is releasably secured to front layer 17 such that the fold may be folded back, thereby exposing the opening 33. Once the fold 15 is folded back, the data card may then be removed from the pocket. After completion of the use of the data card, the card is then returned to the pocket and once again sealed therein. Flap 13 is made up of outer layer 21 and inner layer 27. Preferably, outer layer 21 is transparent. Pocket 11 comprises base layer 31 and front layer 17, which when bonded together along three edges defines a storage space for receiving a data card.

In FIG. 4, a data card 35 is provided which has an optical recording area 37 and an eye-readable data area 39. While wallet-size data cards are preferred, other size cards may be used with the present invention.

In FIG. 5 an embodiment of the present invention is shown wherein protective enclosure 51 includes two pocket sections 49 and 47. Fold 53 covers an opening to pocket 49, not shown, through which a data card may be inserted. A second pocket 47 is hingedly attached to pocket section 49 such that pocket 47 may swing relatively away from pocket section 49. Fold 55 covers an opening, not shown, to pocket 47 and is resealable. Slot 19 provides covenient attachment of a clip, not shown, to the enclosure as is common to identification badges. Pocket 47 may also contain an identification card or a data card. In this way a data card having optically-recorded data may be stored in one pocket while another data card having eye-readable information and limited machine- readable data may be stored in the other pocket. Thus, the recording areas of these data cards will be exposed to the environment only when in use.

Figure 6:
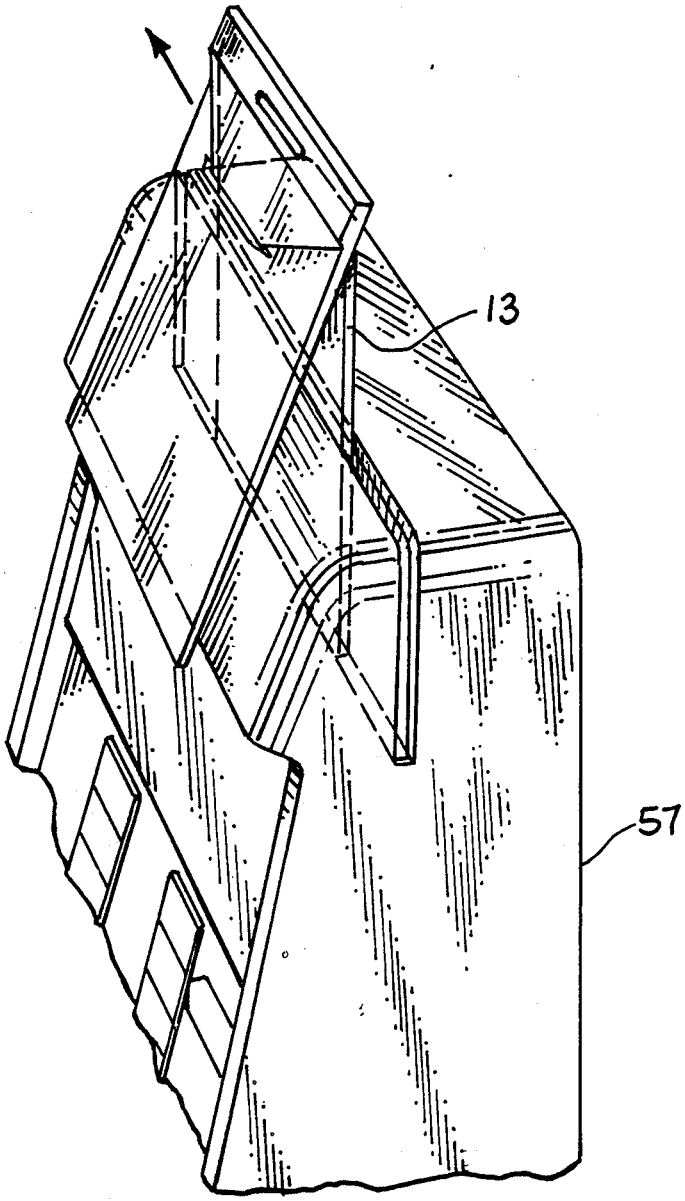
FIG. 6 is an illustrative view of machine reading data contained on the flap section of the present invention.

In general, an enclosure is provided for an optically-written data card. The data card is stored in a pocket of the enclosure, and is only to be taken out of the pocket when in use. A means for resealing the pocket is provided. Hingedly connected to the pocket is a flap. The flap is allowed to swing away from the pocket. Eye-readable information and an identifying photograph can be seen on the outer layer of the flap. Machine-readable data is stored on a magnetic strip 29 on the inside layer of the flap. As shown in FIG. 6, the machine-readable data may be conveniently read by inserting and running the flap 13 through a magnetic card reader 57 of a type commonly known. The photograph may be a picture of a person's face or a thumb print or some other identifying characteristic. Stored on the data card may be a digital recording of the photograph, from which a copy of the photograph can be made. In general use, the flap contains information which may be used often. The data card, stored in the pocket, would contain optically recorded information and would only be out the pocket when in use. Thus, the data card would not be subjected to the environment except when in use. Although, the flap is shown to be of similar size and shape as the pocket, this is not necessary. Various shapes and sizes of the flap and pocket may be incorporated in the present invention.

I claim:

1. A protective information bearing device for a data card comprising, a data card holder including a generally rectangular pocket defined by a front layer and a base layer which further define an opening to the pocket of sufficient size to accommodate a wallet-size data card, the data card holder having an upper end and a lower end, a laminar flap hingedly attached to the base layer near the upper end of the data card holder, said flap having an inside surface facing the pocket and having an outside surface facing in a direction opposite the inside surface, the outside surface bearing eye-visible information discernible from a distance, and means separate from said flap for repeatedly sealing said opening to the pocket.

2. The protective enclosure of claim 1 wherein said pocket holds a data card containing optically-written digital data, and said flap having a recording surface suitable for eye-readable information.

3. The protective enclosure of claim 2 wherein said eye-readable information on the flap includes an identifying photograph between the inside layer and the transparent outside layer of the flap, said photograph facing towards the outside layer.

4. The protective enclosure of claim 2 wherein said inside layer of the flap has machine-readable information disposed thereon.

5. The protective enclosure of claim 1 wherein said means for repeatedly sealing the opening to the pocket is provided by a fold which covers the opening and is releasably secured to the front layer.

6. The protective enclosure of claim 1 further comprising a means for removably attaching the enclosure to a person.

7. The protective enclosure of claim 1 wherein said flap is a pocket such that the enclosure comprises two hingedly connected pockets, each pocket having a sufficient opening to accommodate a wallet-size data card.

8. An information bearing device having as protective enclosure for data cards and having a readily accessible information carrier comprising, a data card holder including a generally rectangular pocket defined by a front layer and a base layer which further define an opening to the pocket of sufficient size to accommodate a wallet-size data card, said pocket containing an optical data card therein, the optical card having optically-written digital data thereon, the data card holder further having an upper end and a lower end with the opening being near the upper end, means for repeatedly sealing said opening to the pocket, a laminate section hingedly attached to the base layer near the upper end of the data card holder, said laminate section having an inside surface facing the pocket and having an outside surface facing outwardly, said inside surface having a machine-readable information record disposed thereon, and said outside surface bearing eye-visible information discernible from a distance, the information contained on the laminate section being associated with a person and the data written on the optical card relating to the information contained on the laminate section, and means for removably attaching said enclosure to a carrier.

9. The protective enclosure of claim 8 wherein said eye-readable information record includes an identifying photograph.

10. The protective enclosure of claim 8 wherein said means for repeatedly sealing the opening to the pocket is provided by a fold which covers the opening, said fold further including a means for releasably securing the fold to the front layer of the pocket.

11. The protective enclosure of claim 8 wherein said flap is a pocket such that the enclosure comprises two hingedly connected pockets, said pockets each having a sufficient opening to accommodate a wallet-size data card.

12. The device of claim 1 wherein said pocket contains a data card having optically-written digital data related to said eye-visible information.

13. The device of claim 12 wherein said eye-visible information includes a photograph.

14. The device of claim 1 wherein said inside surface of said flap contains machine-readable information disposed thereon.

15. The device of claim 14 wherein said machine-readable information is recorded magnetically on a magnetic strip.

16. The device of claim 1 wherein said means for repeatedly sealing the opening to the pocket is provided by a fold which covers the opening and is releasably secured to the front layer.

17. The device of claim 12 wherein said eye-visible information and said optically-written digital data are associated with a person.

18. The device of claim 1 further comprising means for repeated attachment of said device to a person.

19. The device of claim 8 wherein said eye-visible information includes a face photograph of said person.

20. The device of claim 8 wherein said machine-readable information record is recorded magnetically on a magnetic strip disposed on said inside surface.

21. The device of claim 8 wherein said means for repeatedly sealing the opening to the pocket is provided by a fold which covers the opening, said fold further including means for releasably securing the fold to the front layer of the card holder.

22. An information bearing device and dual holder for wallet-size data cards comprising:

a pair of generally rectangular data card holders being hingedly attached to one another along an upper edge of each, each data card holder having similar dimensions and being formed by a base layer and a transparent front layer, the base layer and the front layer defining a pocket therebetween with an opening sufficiently large to accommodate a wallet-size data card, the base layer of data card holder, such that each of the front layers faces outwardly, and independent means for repeatedly sealing each of the openings to said pockets.

23. The device of claim 20 wherein one of said data card holders contains magnetically recorded data on magnetic strip disposed on the base layer of the card holder.

* * * * *

UNITED STATES PATENT AND TRADEMARK OFFICE

CERTIFICATE OF CORRECTION

PATENT NO. : 4,937,963

DATED : July 3, 1990

INVENTOR(S) : Robert B. Barnes

It is certified that error appears in the above-identified patent and that said Letters Patent is hereby corrected as shown below:

laim 8, column 4, line 52, "having as protective enclosure" hould read - - having a protective enclosure - -.

laim 22, column 6, line 29, after "layer of" insert - each data card holder facing the base layer of the other - -.

Signed and Sealed this

First Day of October, 1991

*Attest:*

*Attesting Officer*

HARRY F. MANBECK, JR.

*Commissioner of Patents and Trademarks*